US009426581B2

(12) United States Patent
Khenkin et al.

(10) Patent No.: US 9,426,581 B2
(45) Date of Patent: Aug. 23, 2016

(54) TOP PORT MICROELECTROMECHANICAL SYSTEMS MICROPHONE

(71) Applicant: INVENSENSE, INC., San Jose, CA (US)

(72) Inventors: Aleksey S. Khenkin, Nashua, NH (US); Anthony D. Minervini, Palo Hills, IL (US)

(73) Assignee: INVENSENSE, INC., San Jose, CA (US)

( * ) Notice: Subject to any disclaimer, the term of this patent is extended or adjusted under 35 U.S.C. 154(b) by 32 days.

(21) Appl. No.: 14/294,851

(22) Filed: Jun. 3, 2014

(65) Prior Publication Data

US 2015/0350793 A1 Dec. 3, 2015

(51) Int. Cl.

| | |
|---|---|
| ***H04R 19/00*** | (2006.01) |
| *H04R 1/02* | (2006.01) |
| *H04R 1/28* | (2006.01) |

(52) U.S. Cl.

CPC ..... *H04R 19/005* (2013.01); *H04R 1/02* (2013.01); *H04R 1/2838* (2013.01); *H04R 2201/003* (2013.01)

(58) Field of Classification Search

CPC .... H04R 19/00; H04R 19/04; H04R 19/005; H04R 19/016; H04R 2201/003; H04R 1/02; H04R 1/04; H04R 2499/11; H04L 2924/3025; B81B 2201/0257; B81B 7/0064

See application file for complete search history.

(56) References Cited

U.S. PATENT DOCUMENTS 6,522,762 B1 2/2003 Mullenborn et al.
8,519,492 B2 * 8/2013 Song ..... H04R 19/04 257/416
2010/0158279 A1 6/2010 Conti et al.
2011/0198714 A1 8/2011 Yang
2011/0293126 A1 12/2011 Maekawa et al.
2012/0195797 A1 8/2012 Sparks et al.
2012/0320713 A1 12/2012 Mueller et al.
2013/0075836 A1 * 3/2013 Lee ..... B81B 7/0029 257/416
2013/0193533 A1 * 8/2013 Vos ..... H04R 19/005 257/416
2013/0343590 A1 * 12/2013 Nakagawa ..... H04R 1/04 381/361
2014/0064546 A1 3/2014 Szczech et al.

OTHER PUBLICATIONS

International Search Report and Written Opinion dated Aug. 25, 2015 for PCT Application Serial No. PCT/US2015/033601, 12 pages.

* cited by examiner

*Primary Examiner* — Matthew Eason
(74) *Attorney, Agent, or Firm* — Amin, Turocy & Watson, LLP

(57) ABSTRACT

A top port microelectromechanical systems (MEMS) microphone is presented herein. A device can include a substrate and a MEMS acoustic sensor mechanically attached to the substrate utilizing anchors. Spaces between the anchors can connect a first back volume corresponding to a bottom portion of the MEMS acoustic sensor with a second back volume to form a combined back volume. An acoustic seal can be placed on the MEMS acoustic sensor, and an enclosure placed on the acoustic seal and secured to the substrate. The acoustic seal can isolate a first portion of the enclosure corresponding to a front volume from a second portion of the enclosure corresponding to the combined back volume. The first portion of the enclosure can include an opening adapted to receive acoustic waves into the front volume, and the front volume can be acoustically coupled to a top portion of the MEMS acoustic sensor.

20 Claims, 8 Drawing Sheets

TOP PORT MICROELECTROMECHANICAL SYSTEMS MICROPHONE

TECHNICAL FIELD

This disclosure generally relates to embodiments for a top port microelectromechanical systems (MEMS) microphone.

BACKGROUND

Conventionally, top port MEMS microphones have smaller back volumes and lower performance characteristics than bottom port MEMS microphones of similar size. Consequently, conventional top port MEMS microphone technologies have had some drawbacks, some of which may be noted with reference to the various embodiments described herein.

BRIEF DESCRIPTION OF THE DRAWINGS

Non-limiting embodiments of the subject disclosure are described with reference to the following figures, wherein like reference numerals refer to like parts throughout the various views unless otherwise specified.

DETAILED DESCRIPTION

Figure 1:
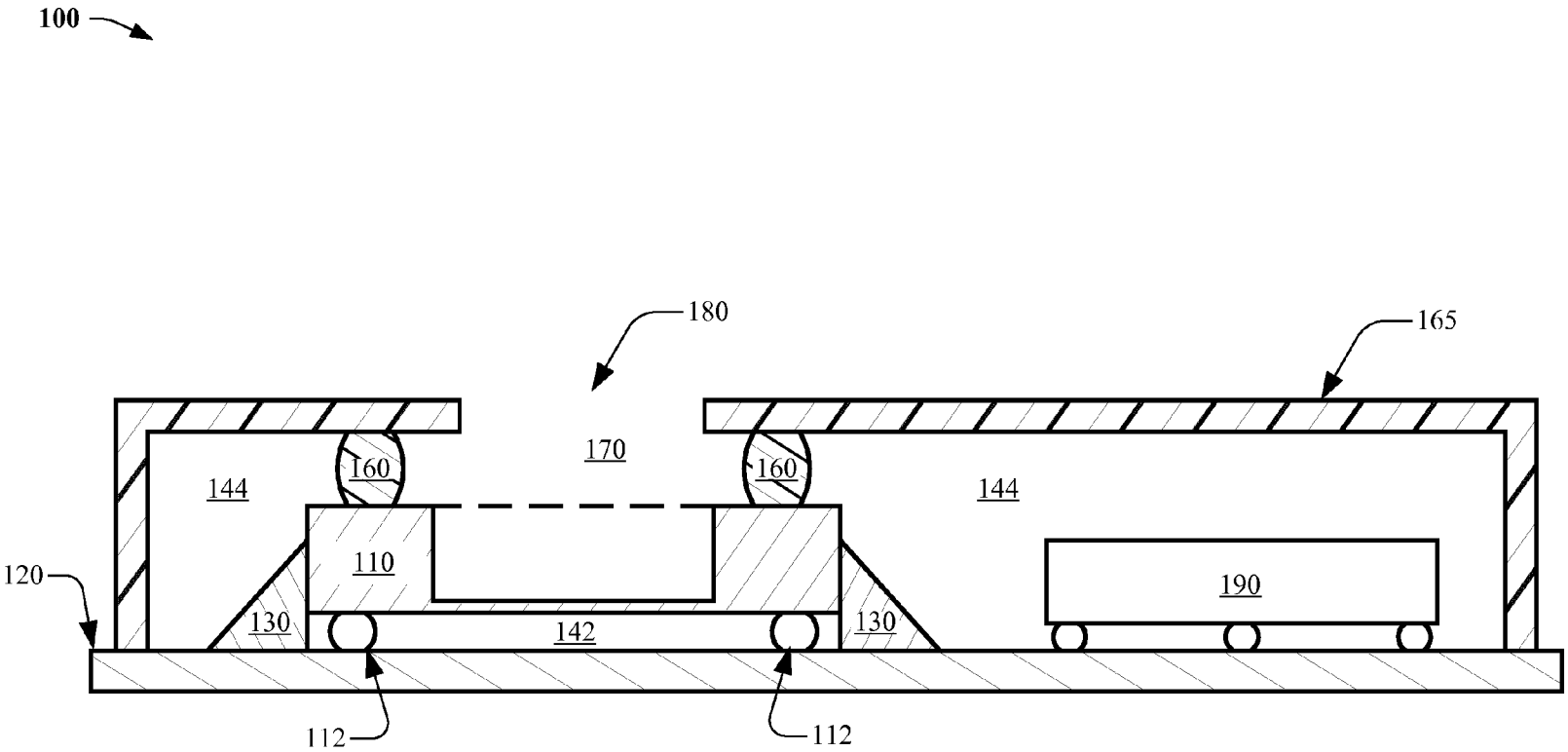
FIG. 1 illustrates a block diagram of a cross section of a top port microelectromechanical systems (MEMS) microphone, in accordance with various embodiments.

Aspects of the subject disclosure will now be described more fully hereinafter with reference to the accompanying drawings in which example embodiments are shown. In the following description, for purposes of explanation, numerous specific details are set forth in order to provide a thorough understanding of the various embodiments. However, the subject disclosure may be embodied in many different forms and should not be construed as limited to the example embodiments set forth herein.

Conventionally, top port MEMS microphones have lower performance characteristics than bottom port MEMS microphones of similar size due to limitations on back volume size. Various embodiments disclosed herein provide bottom port MEMS microphone performance in a top port MEMS microphone by utilizing an entire volume, e.g., hermetically sealed under a MEMS microphone package lid, as a back volume—within a form factor compatible with bottom port MEMS microphones.

For example, a device can include a MEMS acoustic sensor, e.g., MEMS microphone, etc. mechanically attached to a substrate, e.g., printed circuit board (PCB), etc. utilizing a plurality of anchors, e.g., mechanically attached to the substrate at opposite sides of the MEMS acoustic sensor. Spaces between the plurality of anchors can connect a first back volume, e.g., of air, etc. corresponding to a bottom portion of the MEMS acoustic sensor with a second back volume, e.g., of air, to form a combined back volume, e.g., of air. An acoustic seal, e.g., flexible acoustic seal, thixotropic adhesive material, bead of material, etc. can be placed, disposed, etc. on the MEMS acoustic sensor. Further, an enclosure, e.g., lid, cover, etc. can be placed, displaced, etc. on the acoustic seal and attached, secured, sealed, hermetically sealed, mechanically affixed, etc. to the substrate. In this regard, the acoustic seal can isolate a first portion of the enclosure corresponding to a front volume, e.g., of air, from a second portion of the enclosure corresponding to the combined back volume. The first portion of the enclosure can include an opening, port, etc. adapted to receive acoustic waves into the front volume, and the front volume can be acoustically coupled to a top portion of the MEMS acoustic sensor, e.g., acoustically coupled to a diaphragm of the MEMS acoustic sensor, e.g., placed towards, at, within, etc. the bottom portion of the MEMS acoustic sensor.

In an embodiment, the bottom portion of the MEMS acoustic sensor can be electrically coupled to the substrate using flip-chip bonding. In another embodiment, an application specific integrated circuit (ASIC) can be attached to the substrate at a location corresponding to the second back volume, e.g., utilizing flip-chip bonding, etc. and communicatively, electrically, etc. coupled to the MEMS acoustic sensor, e.g., via the substrate.

Another embodiment can include a microphone package including a MEMS microphone attached to a substrate, e.g., PCB, etc. using a die attach material including anchors, e.g., four anchors attached at opposite sides of the MEMS microphone, etc. A bottom side of the MEMS microphone can be attached to the substrate using solder balls, flip-chip bonding, etc., and gaps between the anchors can couple a first volume of air under the bottom side of the MEMS microphone to a second volume of air under an enclosure, lid, cover, etc. The enclosure can be placed on a flexible seal, e.g., thixotropic adhesive material, etc. that has been placed, disposed, etc. on a portion of a top side of the MEMS microphone. Further, the enclosure can be secured, mechanically affixed, sealed, hermetically sealed, etc. to the substrate to separate a front cavity corresponding to the top side of the MEMS microphone from a back cavity including the first volume of air and the second volume of air—the back cavity included within, under, etc. a portion of the enclosure. An opening of the enclosure corresponding to the front cavity can be adapted to couple acoustic pressure to the top side of the MEMS microphone, e.g., acoustically coupled to a diaphragm of the MEMS microphone, e.g., placed within the bottom side of the MEMS microphone.

In one embodiment, the microphone package can include an ASIC attached to the substrate at a location corresponding to the second volume of air and coupled, communicatively coupled, electrically coupled, etc. to the MEMS microphone, e.g., via the substrate. In yet another embodiment, the ASIC can be attached to the substrate using solder balls, flip-chip bonding, etc.

One embodiment can include a method including attaching a MEMS microphone to a substrate, e.g., using flip-chip bonding, etc. and attaching die material to the MEMS microphone and the substrate. A first volume, e.g., of air, etc. under the MEMS microphone can be acoustically coupled, e.g., via gaps between portions of the die material, to a second volume, e.g., of air, etc. to form a back volume, e.g., of air, etc.

Further, the method can include placing, mechanically affixing, disposing, etc. an acoustic seal on the MEMS microphone, placing a package lid on the acoustic seal, and securing, sealing, hermetically sealing, etc. the package lid to the substrate. A first portion of the package lid can include an opening adapted to couple, via a front volume, e.g., of air, etc. sound to a top side of the MEMS microphone. Furthermore, the acoustic seal can isolate the front volume from the back volume, which can be included within, under, etc. a second portion of the package lid.

In an embodiment, the method can include attaching the MEMS microphone to the substrate using flip-chip bonding. In another embodiment, the method can include attaching an ASIC to the substrate, e.g., at a location corresponding to the second volume.

Reference throughout this specification to "one embodiment," or "an embodiment," means that a particular feature, structure, or characteristic described in connection with the embodiment is included in at least one embodiment. Thus, the appearances of the phrase "in one embodiment," or "in an embodiment," in various places throughout this specification are not necessarily all referring to the same embodiment. Furthermore, the particular features, structures, or characteristics may be combined in any suitable manner in one or more embodiments.

Furthermore, to the extent that the terms "includes," "has," "contains," and other similar words are used in either the detailed description or the appended claims, such terms are intended to be inclusive—in a manner similar to the term "comprising" as an open transition word—without precluding any additional or other elements. Moreover, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Furthermore, the word "exemplary" and/or "demonstrative" is used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art.

Figure 2:
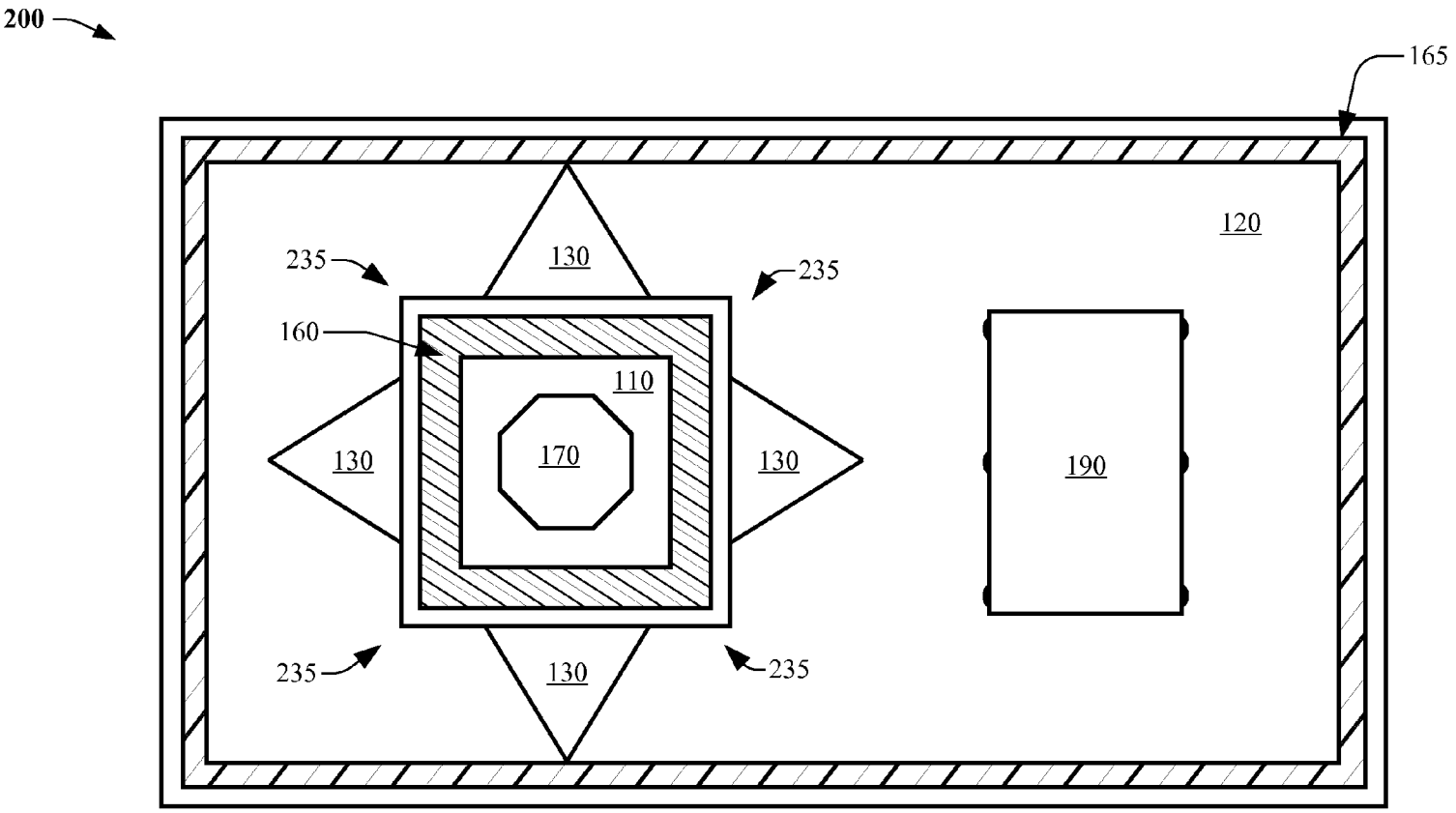
FIG. 2 illustrates a block diagram of a top view of a top port MEMS microphone, in accordance with various embodiments.

Referring now to FIGS. 1 and 2, block diagrams of a cross section of a top port MEMS microphone 100, e.g., a microphone package, etc. and a top view of top port MEMS microphone 100 are illustrated, respectively, in accordance with various embodiments. Top port MEMS microphone 100 can include MEMS acoustic sensor 110, e.g., a microphone, etc. mechanically attached to substrate 120, e.g., a PCB, utilizing anchors 130, e.g., a die attach material, etc. As illustrated by FIG. 2, spaces 235, e.g., gaps, etc. between anchors 130 connect, couple, acoustically couple, etc. first back volume 142, e.g., a volume of air corresponding to a bottom portion, side, surface, etc. of MEMS acoustic sensor 110 to second back volume 144, e.g., a volume of air included under/within portions of lid 16, etc. to form a combined back volume, cavity, etc. (not shown).

Figure 3:
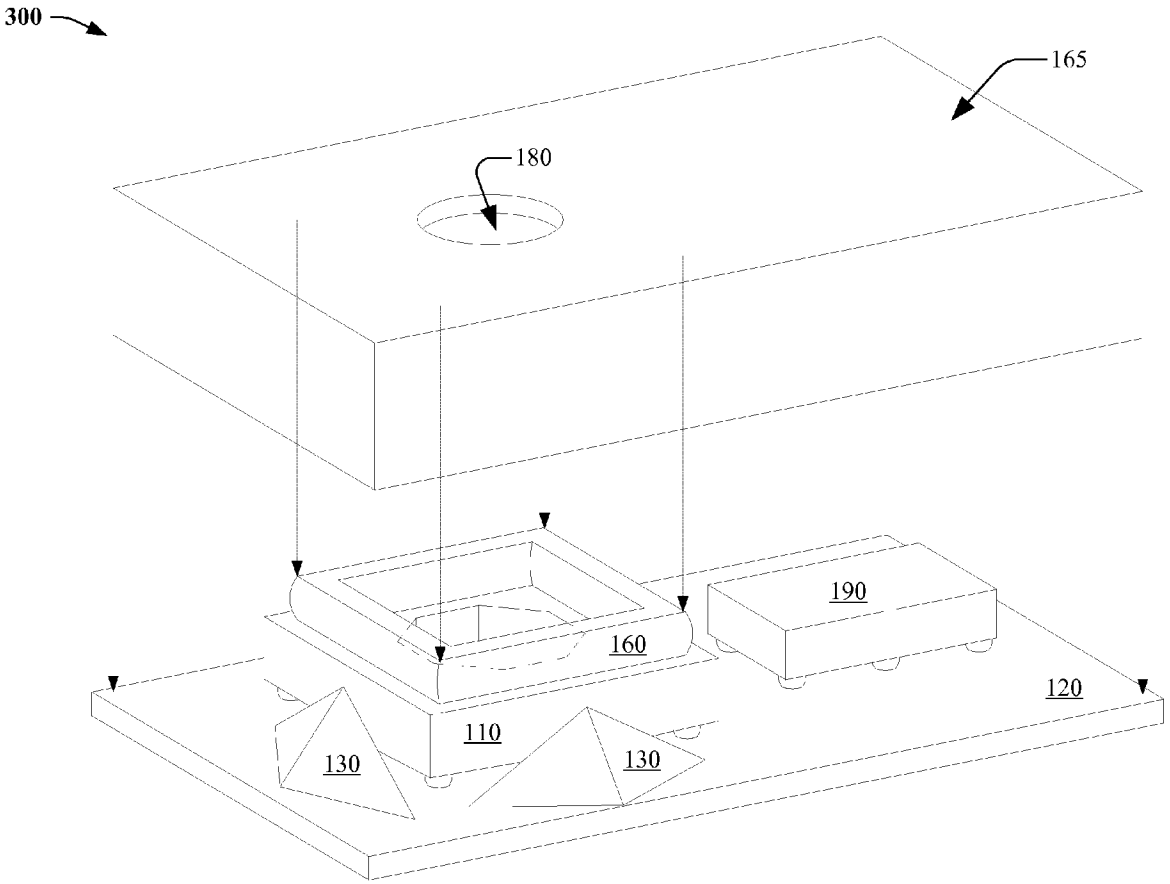
FIG. 3 illustrates a block diagram of a three-dimensional view of an assembly of a top port MEMS microphone, in accordance with various embodiments.

Top port MEMS microphone 100 includes acoustic seal 160, e.g., a flexible seal, a thixotropic adhesive material, etc. placed, dispensed, etc. on MEMS acoustic sensor 110, e.g., as a bead, etc. As illustrated by FIG. 3, enclosure 165, e.g., a lid, a package lid, etc. can be placed on acoustic seal 160 and secured, attached, sealed, hermetically sealed, mechanically affixed, etc. to substrate 120, e.g., compressing acoustic seal 160 to isolate front volume 170 from the combined back volume including first back volume 142 and second back volume 144, e.g., forming an acoustically and/or hermetically sealed enclosure of the combined back volume. In this regard, top port MEMS microphone 100 can utilize a volume of air corresponding to the underside of MEMS acoustic sensor 110 and the underside of enclosure 165 as the combined back volume, e.g., achieving improved signal-to-noise ratio (SNR) performance over conventional top port MEMS technologies of similar size.

In one embodiment, opening 180, e.g., a port, etc. of enclosure 165 is adapted to receive acoustic waves, e.g., acoustic pressure, sound pressure, etc. into front volume 170, which is acoustically coupled to a top portion, side, etc. of MEMS acoustic sensor 110. In another embodiment, a bottom portion, side, etc. of MEMS acoustic sensor 110 can be electrically coupled to substrate 120 utilizing flip-chip bonding, e.g., via solder balls 112. In yet another embodiment, the bottom portion of MEMS acoustic sensor 110 can include a diaphragm, e.g., a transducer, etc. (not shown) configured to convert sound vibrations into electrical signals. In an embodiment, ASIC 190 can be attached to substrate 120, e.g., using flip-chip bonding, etc. at a location corresponding to second back volume 144. Further, ASIC 190 can be communicatively, electrically, etc. coupled to MEMS acoustic sensor 110, e.g., via substrate 120, to receive the electrical signals from MEMS acoustic sensor 110.

Figure 4:
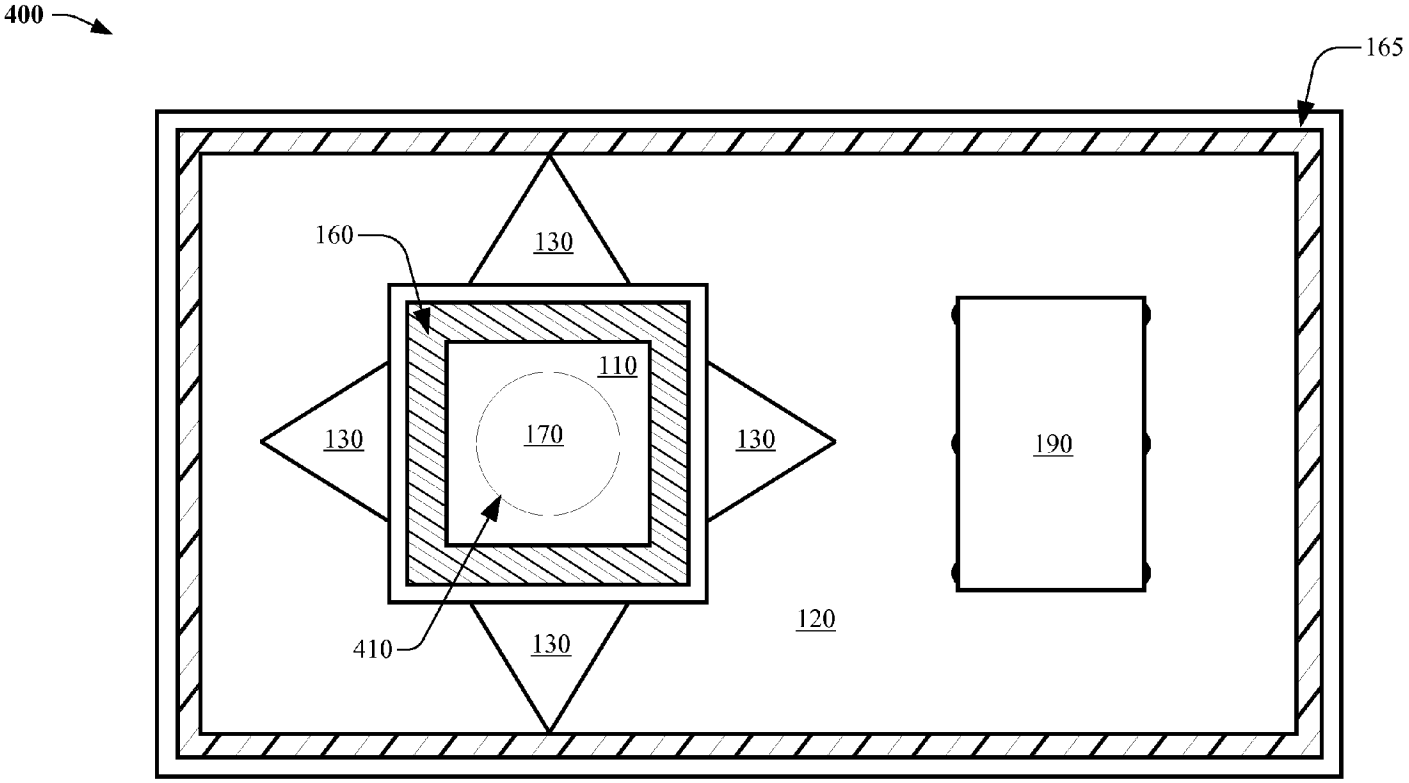
FIGS. 4-6 illustrate block diagrams of top views of top port MEMS microphones corresponding to various top port openings, in accordance with various embodiments.
Figure 5:
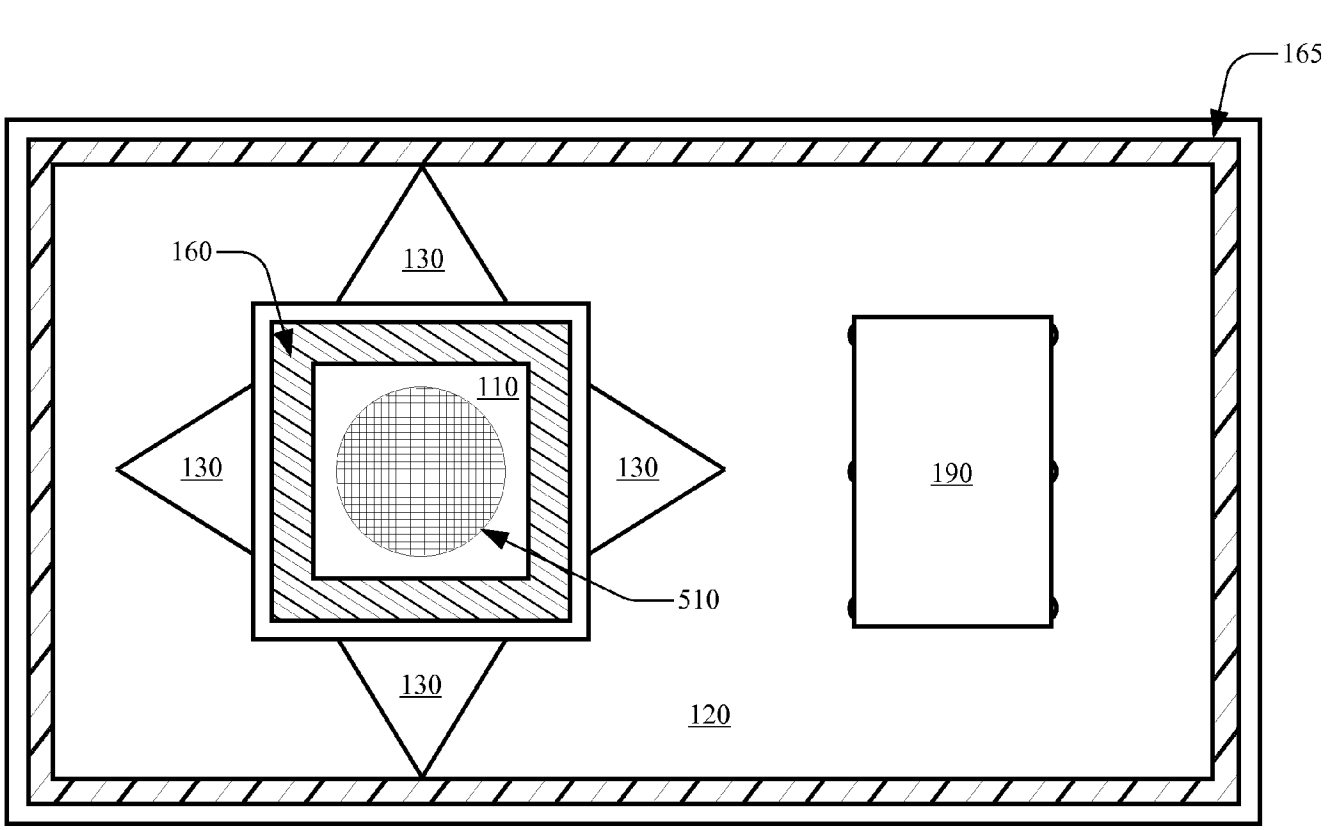
Figure 6:
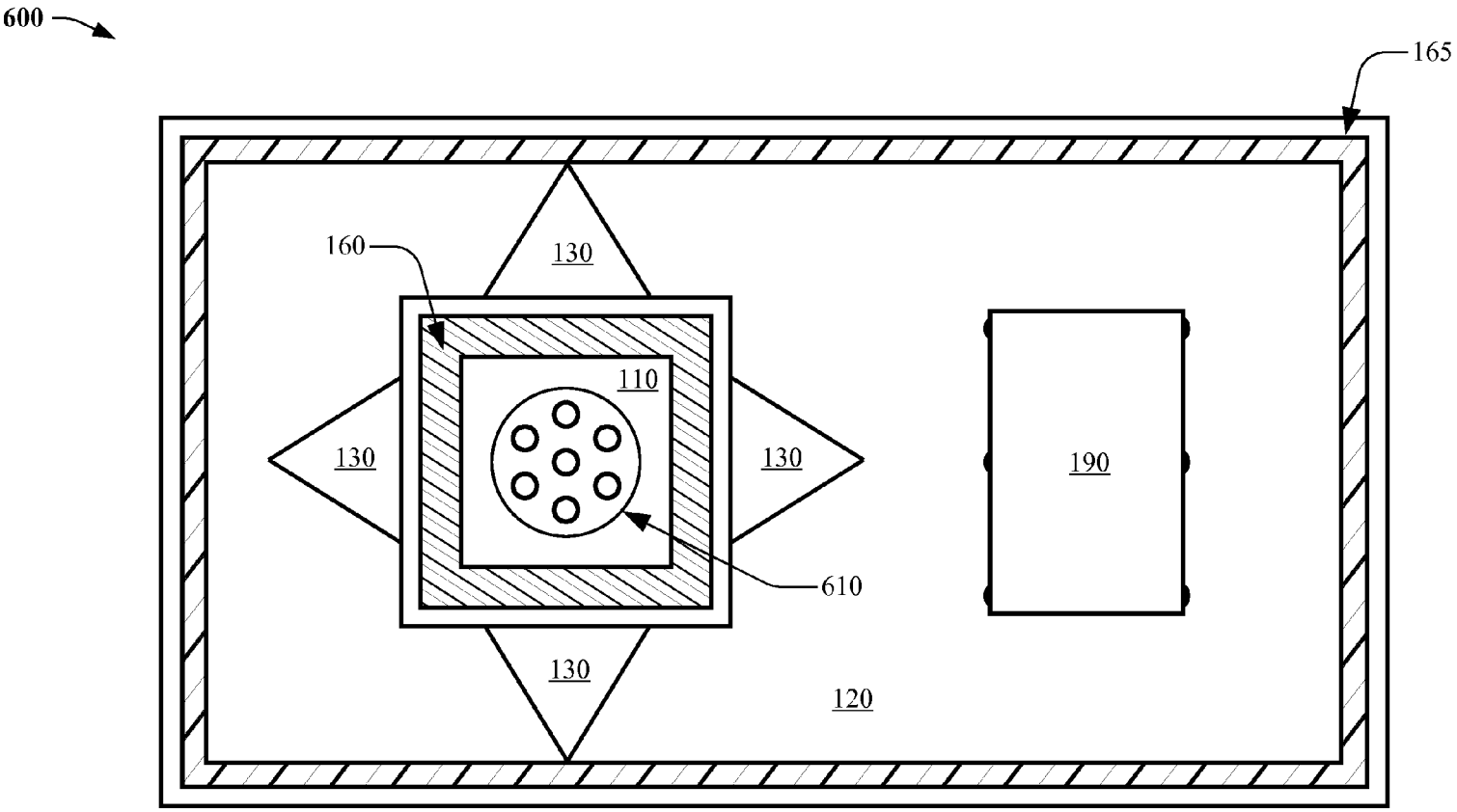

Referring now to FIGS. 4-6, block diagrams of top views of top port MEMS microphones (100) corresponding to openings, ports, etc. of enclosure 165, e.g., circular opening (410), screened opening (510), multi-circular opening (610) are illustrated, in accordance with various embodiments. In various non-limiting aspects, the openings of enclosure 165 and/or MEMS acoustic sensor 110 can comprise various shapes, coverings, etc. known, available, etc. to those skilled in the art of MEMS microphone technologies.

Figure 7:
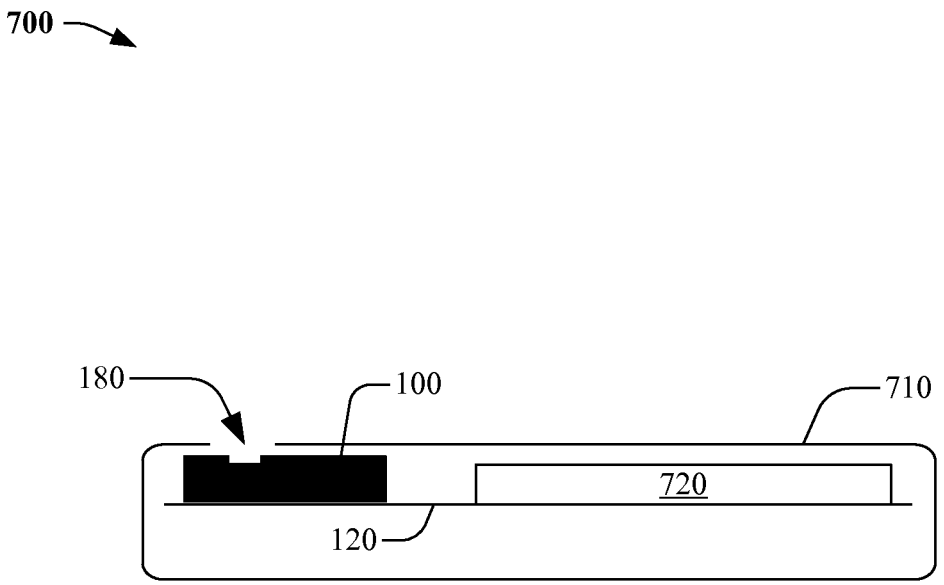
FIG. 7 illustrates a block diagram of a system including a top port MEMS microphone, in accordance with various embodiments.

FIG. 7 illustrates a block diagram of system 700, e.g., a portable computing device, a smartphone, a cellular device, a wireless computing device, a wireless communication device, a handheld computing device, a recording device, etc. including top port MEMS microphone 100, in accordance with various embodiments. Enclosure 710 of system 700 can include opening 180, e.g., port, etc. configured to couple acoustic pressure, sound waves, etc. to front volume 170 of top port MEMS microphone 100. Further, ASIC 720, which can include, e.g., computing device(s), memory device(s), computing system(s), etc. for facilitating operation of system 700, can be attached to substrate 120, e.g., PCB, and communicatively coupled, electrically coupled, etc. to ASIC 190, e.g., via substrate 120. In other embodiments (not shown), top port MEMS microphone 100 can be communicatively coupled, electrically coupled, etc., e.g., via ASIC 190, to other substrates, devices, etc. included within system 700.

Figure 8:
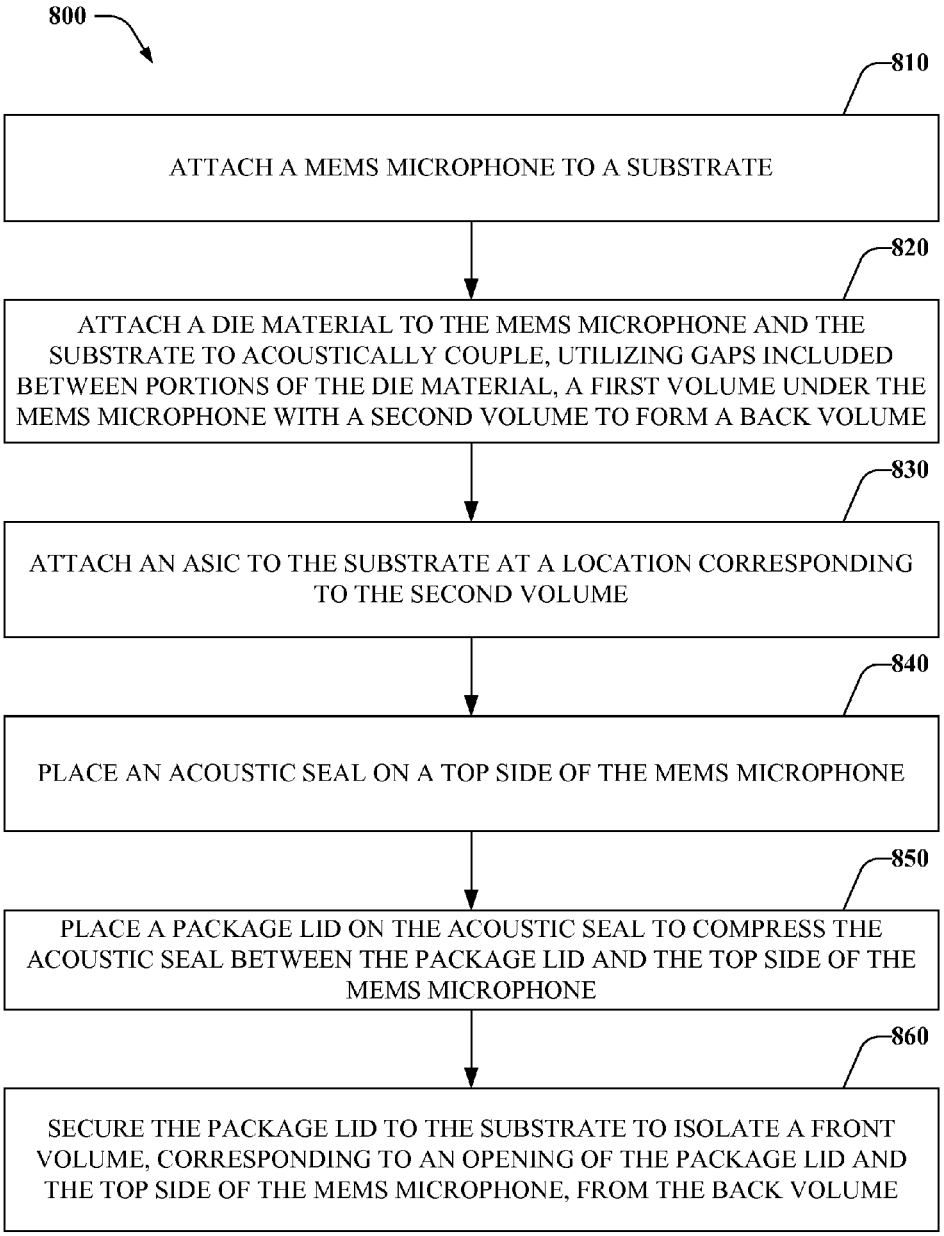
FIG. 8 illustrates a flow diagram of a method for assembling a top port MEMS microphone, in accordance with various embodiments.

Referring now to FIG. 8, a flow diagram of a method (800) for assembling a top port MEMS microphone, e.g., 100, is illustrated, in accordance with various embodiments.

The order in which some or all of the process blocks appear in method 800 should not be deemed limiting. Rather, it should be understood by a person of ordinary skill in the art having the benefit of the instant disclosure that some of the process blocks can be executed in a variety of orders not illustrated. At 810, a MEMS microphone, e.g., MEMS acoustic sensor 110, etc. can be attached to a substrate, e.g., PCB, for example, utilizing flip-chip bonding. At 820, a die material, anchors, etc. can be attached to the MEMS microphone and the substrate, e.g., at opposite sides of the MEMS microphone, to acoustically couple, utilizing gaps, spaces, etc. included between portions of the die material, a first volume under the MEMS microphone with a second volume to form a back volume.

At 830, an ASIC can be attached to the substrate at a location corresponding to the second volume, e.g., utilizing flip-chip bonding, etc. At 840, an acoustic seal, e.g., a flexible acoustic seal, a thixotropic adhesive material, etc. can be placed, dispensed, etc. on a top side, portion, etc. of the MEMS microphone, e.g., as a bead, etc. At 850, a package lid, lid, enclosure, etc. can be placed on the acoustic seal to compress the acoustic seal between the package lid and the top side, portion, etc. of the MEMS microphone. At 860, the package lid can be secured, attached, sealed, hermetically sealed, mechanically affixed, etc. to the substrate to isolate a front volume, corresponding to an opening of the package lid and the top side, portion, etc. of the MEMS microphone, from the back volume.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A device, comprising:

a substrate;

a micro-electro-mechanical system (MEMS) acoustic sensor mechanically attached to the substrate utilizing a plurality of anchors comprising a die attach material that is external to the MEMS acoustic sensor, wherein spaces between the plurality of anchors connect a first back volume corresponding to a bottom portion of the MEMS acoustic sensor with a second back volume to form a combined back volume, and wherein the plurality of anchors are mechanically attached to the substrate and to opposite sides of the MEMS acoustic sensor at a periphery of the MEMS acoustic sensor;

an acoustic seal placed on the MEMS acoustic sensor; and an enclosure placed on the acoustic seal and secured to the substrate, wherein the acoustic seal isolates a first portion of the enclosure corresponding to a front volume from a second portion of the enclosure corresponding to the combined back volume, wherein the first portion of the enclosure comprises an opening adapted to receive acoustic waves into the front volume, and wherein the front volume is acoustically coupled to a top portion of the MEMS acoustic sensor.

2. The device of claim 1, wherein the substrate is a printed circuit board (PCB).

3. The device of claim 2, wherein the bottom portion of the MEMS acoustic sensor is electrically coupled to the PCB utilizing flip-chip bonding.

4. The device of claim 1, wherein the acoustic seal comprises a thixotropic adhesive material.

5. The device of claim 1, further comprising:

an application specific integrated circuit (ASIC) attached to the substrate at a location corresponding to the second back volume and communicatively coupled to the MEMS acoustic sensor.

6. The device of claim 5, wherein the ASIC is attached to the substrate utilizing flip-chip bonding.

7. The device of claim 1, wherein the bottom portion of the MEMS acoustic sensor comprises a diaphragm.

8. The device of claim 1, wherein the MEMS acoustic sensor comprises a MEMS microphone.

9. A microphone package, comprising:

a substrate;

a microelectromechanical system (MEMS) microphone attached to the substrate using die attachments comprising anchors that are external to the MEMS microphone, wherein gaps between the anchors couple a first volume of air under a bottom side of the MEMS microphone to a second volume of air, and wherein the anchors are mechanically attached to the substrate and to opposite sides of respective outside edges of the MEMS microphone;

a flexible seal placed on a portion of the top side of the MEMS microphone; and an enclosure placed on the flexible seal and secured to the substrate, wherein the flexible seal separates a front cavity corresponding to a top side of the MEMS microphone from a back cavity comprising the first volume of air and the second volume of air, wherein an opening of the enclosure corresponding to the front cavity is adapted to couple acoustic pressure to the top side of the MEMS microphone, and wherein the back cavity is included within a portion of the enclosure.

10. The microphone package of claim 9, wherein the substrate comprises a printed circuit board (PCB).

11. The microphone package of claim 10, wherein the bottom side of the MEMS microphone is attached to the PCB using solder balls.

12. The microphone package of claim 9, wherein the bottom side of the MEMS microphone comprises a diaphragm.

13. The microphone package of claim 9, wherein the flexible seal comprises a thixotropic material.

14. The microphone package of claim 9, wherein the anchors comprise four anchors attached at the opposite sides of the MEMS microphone.

15. The microphone package of claim 9, further comprising:

an application specific integrated circuit (ASIC) attached to the substrate at a location corresponding to the second volume of air and communicatively coupled to the MEMS microphone.

16. The microphone package of claim 15, wherein the ASIC is attached to the substrate using solder balls.

17. A method, comprising:

attaching a microelectromechanical (MEMS) microphone to a substrate;

attaching die material, external to the MEMS microphone, to the substrate and to respective sides of the MEMS microphone at a periphery of the MEMS microphone, wherein gaps between portions of the die material acoustically couple a first volume under the MEMS microphone with a second volume to form a back volume;

placing an acoustic seal on the MEMS microphone; and placing a package lid on the acoustic seal and securing the package lid to the substrate, wherein a first portion of the package lid comprises an opening adapted to couple, via a front volume, sound to a top side of the MEMS microphone, wherein the back volume is included within a second portion of the package lid, and wherein the acoustic seal isolates the front volume from the back volume.

18. The method of claim 17, wherein the attaching the MEMS microphone to the substrate comprises attaching the MEMS microphone to the substrate using flip-chip bonding.

19. The method of claim 17, further comprising:

attaching an application specific integrated circuit (ASIC) to the substrate at a location corresponding to the second volume.

20. The device of claim 1, wherein the plurality of anchors comprises four anchors mechanically attached to the substrate at the opposite sides of the MEMS acoustic sensor.

* * * * *